United States Patent [19]

Miles et al.

[11] 4,221,643

[45] Sep. 9, 1980

[54] PROCESS FOR THE PREPARATION OF LOW HYDROGEN OVERVOLTAGE CATHODES

[75] Inventors: Ronald C. Miles; Larry D. Carpenter, both of Cleveland, Tenn.

[73] Assignee: Olin Corporation, New Haven, Conn.

[21] Appl. No.: 63,016

[22] Filed: Aug. 2, 1979

[51] Int. Cl.[2] ..... C25B 1/16; C25B 1/26; C25B 11/02; C25B 11/03

[52] U.S. Cl. ..... 204/98; 204/23; 204/35 R; 204/290 R

[58] Field of Search ..... 204/25, 35 R, 98, 128, 204/290 R, 293, 284, 23, 24

[56] References Cited

U.S. PATENT DOCUMENTS

| | | | |
|---|---|---|---|
| 3,291,714 | 12/1966 | Hall et al. | 204/256 |
| 4,104,133 | 8/1978 | Brannan | 204/25 |

OTHER PUBLICATIONS

German Offenlegungsschrift No. 2,807,054, File No. P28 07 054.4, appln. date Feb. 18, 1978, disclosure date Aug. 24, 1978, "Electrode" Yoshio Oda et al.

Netherlands, appln. No. 75-07550, filed Jun. 15, 1975, laid open to inspection Jan. 20, 1976, "Electrolytic Cathode and Processes for the Manufacture Thereof".

*Primary Examiner*—T. M. Tufariello

*Attorney, Agent, or Firm*—Gordon F. Sieckmann; Donald F. Clements

[57] ABSTRACT

An improved process is described for the electrodeposition of both a low overvoltage metal and a sacrificial metal onto an electrically conductive substrate. The sacrificial metal is later removed by leaching the electroplated substrate with sodium hydroxide. The improvement comprises adding a sacrificial metal to the electroplating solution after electrodeposition is initiated. The amount of electric current supplied to the electroplating solution during electrodeposition may be increased or decreased to increase the surface area and the electrochemical activity of the electroplated substrate.

14 Claims, No Drawings

PROCESS FOR THE PREPARATION OF LOW HYDROGEN OVERVOLTAGE CATHODES

This invention relates to methods for the reduction of overvoltage in electrolytic cells. More specifically, this invention relates to an improved method of depositing low overvoltage metal on an electrically conductive substrate such as a cathode of an electrolytic cell to reduce the hydrogen overvoltage thereof.

It is well known that the voltage drop between an anode and a cathode in an electrolytic cell in which gases are generated at the electrodes is made up of a number of components, one of which is the overvoltage for the particular electrodes concerned. In industrial applications of electrolytic cells, it is very important from the viewpoint of operating cost to reduce to a minumum the voltage drop for an electrolytic process. This leads to the use of electrodes having the lowest overvoltage potential in the system employed. For example, in the electrolysis of an aqueous solution of an alkali metal halide such as an aqueous solution of sodium chloride to produce hydrogen, chlorine and sodium hydroxide, the cathode having the lowest hydrogen overvoltage is highly desired.

A number of innovators have produced various plated electrodes for use in electrolytic cells so as to achieve a low overvoltage potential with a cathode of a base material that would otherwise have a somewhat higher overvoltage potential. Typically, electrodes developed in this area can be classified as "sacrificial metal alloy electrodes". This term encompasses electrodes which have had at least two materials deposited on their surfaces, one material of which is designed to be removed, for example, by contacting with sodium hydroxide, before the electrode is put to use. The removal of the sacrificial metal increases both the surface area and the electrochemical activity of the operating electrode.

U.S. Pat. No. 3,291,714, issued Dec. 13, 1966 to J. R. Hall et al gives data on many plating systems and coatings on steel or titanium substrates, the coatings being utilized to reduce hydrogen overvoltage potential. The Hall et al patent shows, in particular, nickel, molybdenum and tungsten based platings.

Other patents disclose using an alloy of zinc and nickel as an electroplating solution so as to achieve a low overvoltage potential with a cathode of a base material that would otherwise have a somewhat higher voltage potential include U.S. Pat. No. 4,104,133, issued Aug. 1, 1978 to James R. Brannan et al. The teachings of this patent are incorporated herein in its entirety by reference.

One fundamental persistent problem that can affect all the processes covered in the references is that if there is too much sacrificial metal, the bond between the remaining metal and the substrate is weakened. If the concentration of sacrificial metal is too low, the final electrochemical activity can be low.

Despite the aforementioned patents and others, a need still exists in this particular art for the improved method of electroplating a low overvoltage metal on an electrically conductive substrate to prepare an electroplated cathode which has a high amount of sacrificial metal and a high electrochemical activity.

OBJECTS

It is a primary object of the presnt invention to provide a method for lowering hydrogen overvoltage of cathodes in operating electrolytic cells.

It is another object of the present invention to provide a method for preparing a coated electrode which has a high surface area and a high electrochemical activity.

These and other objects of the invention will become apparent to those skilled in the art upon reading the specification and claims.

BRIEF DESCRIPTION OF THE INVENTION

These and other objects of the invention are achieved in a process for the reduction of cathodic hydrogen overvoltage potential of an electrolytic cell, wherein a low overvoltage metal and a sacrificial metal are electrodeposited onto an electrically conductive substrate by insertion of the electrically conductive substrate into an electroplating solution along with a plating anode, and an electric current is passed from the plating anode to the electrically conductive substrate and the sacrificial metal is removed from the electroplated substrate by leaching with alkali metal hydroxide, the improvement which comprises adding a sacrificial metal to the electroplating solution after electrodeposition is initiated. The amount of current supplied to the electroplating solution may also be varied.

DETAILED DESCRIPTION OF THE INVENTION

In the process of this invention, a low overvoltage metal and a sacrificial metal are electrodeposited onto a clean electrically conductive substrate.

Typically, electrically conductive materials include materials employed as cathode substrate in electrolytic cells, for example, membrane type monopolar and bipolar filter press cells employed in the electrolysis of aqueous solutions of alkali metal halide solutions. As used herein, the term "membrane type" means having either a membrane or diaphragm whether it is porous, semiporous, nonporous or an ion exchange membrane such as a permselective membrane.

The cathode substrate may be made of any electrically conductive material having the needed mechanical properties and chemical resistance to the electrolyte solution in which it is to be used.

The cathode substrate may have any given shape or size, which is adapted to the cell, in which the cathode is in operation. The cathode may have the shape of wire, tube, rod, flat or curved plate, perforated plate, expanded metal, wire gauze, gauze, or porous mixture such as fused metal powder. The cathode can be prepared from any suitable conducting material, such as titanium, zirconium, vanadium, niobium, tantalum, chromium, molybdenum, tungsten, manganese, rhenium, iron, ruthenium, osmium, cobalt, rhodium, iridium, nickel, palladium, platinum, copper, silver, gold, carbon or mixtures thereof. The chosen materials must be suitable for the construction of the desired shape. Preferred cathode substrate are iron, copper, nickel, chromium, graphite and mixtures or alloys thereof. Especially preferred cathode substrate iron, nickel and copper and alloys thereof, particularly, steel, such as carbon steels, iron/nickel alloys and stainless steels such as iron/chromium alloys and iron/nickel/chromium alloys. Other preferred cathode materials are mixtures of iron and copper and alloys based on nickel such as nickel/copper alloys, nickel/iron alloys, nickel/cobalt alloys and nickel/chromium alloys.

Typically, the surface of such electrically conductive substrate is coated conductively with a microporous coating of both a low overvoltage metal, and a sacrificial metal. As used herein, the term "low overvoltage metal" means a metal or an alloy, which when plated on a cathode of a given electrically conductive substrate results in a lower hydrogen overvoltage than that which the electrically conductive substrate would exhibit, if unplated, where hydrogen overvoltage is defined as H and where H=Ei-Eo, where Ei is the electrode potential under load and Eo is the reversible electrode potential.

The low overvoltage metal contains at least one of the desired non-noble metals, chosen from the group consisting of copper, nickel, cobalt, manganese chromium and iron. Alloys may also be employed as low overvoltage metals. Preferred alloys are, for example, nickel-aluminum and nickel-zinc. A particularly preferred alloy is a nickel/zinc alloy.

The sacrificial metal must be such that it can be selectively removed later from the alloy coating preferably without removal of significant amounts of the non-noble low overvoltage metal. The selective removal can be achieved by differences in the solubility in a solvent and by electrochemical activity. Accordingly, useful sacrificial metals are metals, which can be alloyed with the chosen non-noble metal, and which can be selectively removed from the coating applied, and which do not unfavorably influence the cathodic potential drop when a little of the metal remains on the catode after the selective removal operation. Typical sacrificial metals, which are useful with one or more of the non-noble metals, are aluminum, magnesium, gallium, tin, lead, cadmiun, bismuth, antimony, zinc, mixtures thereof and the like.

The above-mentioned sacrificial metals must be selectively adapted to each of the non-noble metals, in connection with the intended removal process of the sacrificial metal and in connection with the intended use of the cathode. One or more of the sacrificial metals may be suitable with one or more of the non-noble metals. Preferred sacrificial metals are aluminum, zinc, magnesium, tin, mixtures thereof and the like.

A typical electrically conductive substrate is a metal cathode of an electrolytic cell.

While cathodes may be electroplated without removing the same from an electrolytic cell, as disclosed in U.S. Pat. No. 4,104,133, supra, those of skill in the art will recognize that electrodeposition may be easily accomplished by removing cathodes from the electrolytic cell for cleaning purposes and placed in a suitable cleaning bath.

Prior to being coated, the surfaces of the cathode substrate, for example, copper or nickel surfaces, are preferably cleaned in a suitable container or cleaning bath to remove any contaminants that could diminish adhesion of the coating to the cathode substrate by means such as vapor degreasing, chemical etching, sandblasting and the like. The term "clean" as used herein in reference to metal surfaces means a metal surface that is sufficiently free from objectionable organic or inorganic films to allow electroplating of low overvoltage metal adherent coatings thereupon. All or part of the cathode surface may be coated depending on the type of electrolytic cell in which the cathode is to be employed.

The cathodes are rinsed and cleaned by any manner common in the electroplating art in order to provide a clean surface on the cathodes. Any known cleaner may be used for this purpose. An acid pickle following cleaning is also common in the plating art in order to neutralize any residual alkaline cleaner and also to remove any oxide ions from the cathodes.

The cleaned cathode such as nickel cathode is then immersed in an electroplating solution which will deposit both a low overvoltage metal and a sacrificial metal on the electrically conductive substrate.

The electroplating solution may be any electroplating solution common in the art such as a sulfate, sulfamate, fluoroborate, pyrophosphate, chloride, mixtures thereof and the like. A typical electroplating solution is a nickel chloride/zinc chloride bath as described in U.S. Pat. No. 4,104,133, supra.

A preferred electroplating solution commonly known as a Watts bath is disclosed in the *Guidebook for Metal Finishing*, N. Hall-Ed., Published by Metals and Plastics Publications, Inc., Hackensack, N.J. 07601 (1977) page 266 and contains the following components in concentration ranges as shown in Table I:

TABLE I

| | Preferred Electroplating Bath | |
|---|---|---|
| | Concentration Range (Grams Per Liter) | |
| Component | Broad | Preferred |
| $NiSO_4$ | 200–400 | 300–375 |
| $NiCl_2$ | 25–100 | 30–60 |
| Boric Acid | 10–75 | 20–60 |

Components other than those shown in Table I may be employed in the process of this invention. Greater or lesser concentrations of the components shown in Table I may be employed as the original electroplating solution.

The electrically conductive substrate is inserted into an electroplating solution containing a low overvoltage metal are similar to that shown in Table I above. A plating anode such as an anode comprised of nickel is also inserted in the electroplating solution. The term "plating anode" is used to indicate a soluble or insoluble anode used for the electrodesposition of an electroplated metal coating on the electrically conductive substrate. The electrically conductive substrate is connected to the negative terminal of a direct current supply, and the plating anode is connected to the positive terminal of a direct current supply. The electric current is turned on and flows from the plating anode to the electrically conductive substrate. This results in the electrodeposition of low hydrogen overvoltage metal from the electroplating solution on the electrically conductive substrate.

The hydrogen overvoltage of the electroplated electrically conductive substrate is remarkably decreased when a sacrificial metal is added to the electroplating solution after electrodeposition is initiated.

For example, when a $NiSO_4$-$NiCl_2$-boric acid electroplating bath is employed similar to that shown in Table I above, a sacrificial metal is added to the electroplating solution after an electrodeposition has occurred for about five minutes.

The sacrificial metal is typically added to the initial electroplating solution in the form of an aqueous solution, whereby the sacrificial metal is in soluble form.

The sacrificial metal such as zinc metal is typically added in the form of an aqueous solution of $ZnCl_2$. The concentration of $ZnCl_2$ in the solution added to the electroplating solution is in the range from about 100 to about 4,000 and preferably from about 1,000 to about 2,000 grams $ZnCl_2$ per liter.

The final concentration of sacrificial metal, such as $ZnCl_2$, in the electroplating solution is in the range from about 0.1 to about 1000 and preferably from about 1 to about 50 grams zinc chloride per liter. Electrodeposition is continued during the extended time that the concentration of zinc chloride is increased and for a short time thereafter. The extended time period is in the range from about 0.05 to about 1.0 and preferably from about 0.25 to about 0.5 hour.

While the concentration of zinc chloride may be increased by a single or a plurality of additions of the desired amount of zinc chloride, it is preferred to add the zinc chloride slowly over the previously described time period as, for example, by the continuous addition of zinc chloride over the previously described time period.

After the desired metal alloy coating is applied to the electrically conductive substrate, the microporous surface of the substrate can easily be prepared by selectively removing at least a portion of the electrodeposited material, preferably the sacrificial metal. The preferred method is contacting the electroplated cathode structure which is coated with the low overvoltage metal and sacrificial metal with an alkali metal hydroxide solution, such as an aqueous solution of sodium hydroxide, which is sufficient to selectively dissolve the sacrificial metal without attacking the non-noble metal. A small portion of the non-noble metal can also be removed without significant damage to the coated substrate. The concentration of sodium hydroxide of metal dissolving solution is in the range from about 5 to about 40 and preferably from about 10 to about 30 percent sodium hydroxide by weight. The temperature of the sodium hydroxide solution is in the range from about 20° to about 60° C.

In an embodiment of the process of this invention, the hydrogen overvoltage of the electroplated electrically conductive substrate employed as a cathode in an electrolytic cell is remarkably decreased when the amount of current is varied during electrodeposition to produce a change in the electric current density supplied to the electroplating solution.

For example, the amount of current supplied to the electroplating solution is appreciably decreased over the initial current supply to the electroplating solution after the sacrificial metal has been added to the electroplating solution for an extended time period. For example, when an electroplating solution is employed, similar to that illustrated in Table I above, the initial current density is in the range from about 0.001 to about 1.0 and preferably from about 0.05 to about 0.5 ampere per centimeter square, and is employed for a period of time in the range from about 0.1 to about 2.0 and preferably from about 0.5 to about 1.0 hours.

The hydrogen overvoltage is electroplated electrically conductive substrate is remarkably decreased during subsequent electrolysis when the current density is decreased from the initial current density described above to an intermediate current density in the range from about 0.0001 to about 0.01 and preferably from about 0.001 to about 0.005 ampere per centimeter square for an extended time period of about 1/60 to about 1 hour. Thereafter, the current supplied to the electroplating solution is incrementally increased to a final current density in the range from about 0.05 to about 0.2 ampere per square centimeter for a time period of about 0.5 to about 1 hour.

The number of current density increases is in the range from 1 to about 20 and preferably from about 2 to about 10. The time period of each variation is in the range from about 5–25 and preferably from about 10 to about 20 minutes. The number of current density variations may be increased as needed to further increase the electrochemical activity and surface area of the coated electrically conductive substrate. The current may be increased or decreased during electrodeposition as required to improve the surface area and electrochemical activity of the electroplated cathode.

At the end of the extended time period of current variation, the electric current is shut off to the electroplating bath and the coated electrically conductive substrate is removed from the electroplating bath. The coated electrically conductive substrate is then contacted with sodium hydroxide as previously described.

As a further means of preparing an active coating, the pH may be varied during the electroplating sequence in order to control the composition of the coating. In this embodiment, the pH of the electroplating solution is in the range from about 1.5 to 6.0 and preferably from about 2.5 to 5.5.

Without being bound by theory, it is believed that the application of these discoveries as previously described result in maintaining the concentration of sacrificial metal such as zinc at a low concentration at a level deep in the coating near the electrically conductive substrate surface and at a gradually increasing concentration near the surface of the applied coating. After leaching with sodium hydroxide, it is believed that the loosely adhering but active outer layer slowly begins to fall off with service until the lower adhering underlayers are gradually exposed. It is further believed that as the electrode slowly ages in service, the coating produced by the process of this invention is more likely to be worn away very gradually over a long period of two or more years rather than be completely removed.

The following examples are presented to define the invention more fully without any intention of being limited thereby. All parts and percentages are by weight unless indicated otherwise.

EXAMPLE 1

A section of louvered copper mesh was selected as an electrically conductive substrate for electroplating. The louvered copper mesh section was about 0.1 centimeter thick, about 6.5 centimeters long and about 9.0 centimeters high. The diamond shaped apertures in the mesh were about 2.2 centimeters long and about 0.4 centimeter wide.

About 950 milliliters of an aqueous electroplating solution (hereafter referred to as the initial electroplating solution) was prepared having the following composition:

about 330 grams per liter (g/l) $NiSO_4$;

about 45 g/l $NiCl_2$;

about 37 g/l boric acid;

the pH of the initial electroplating solution was about 3 to about 4; and the temperature of the initial electroplating solution was about 60° C.

The louvered copper mesh was inserted into the initial electroplating solution. The copper mesh was electrically connected to the negative terminal of a direct current supply and a plating anode of nickel was connected to the positive terminal of the same direct current supply. The current was turned on and the current density was about 0.095 ampere per square centimeter for about five minutes.

About 45 milliliters of about 1 kg/l aqueous $ZnCl_2$ solution was then added to the initial electroplating solution as the current density was maintained about 0.095 ampere per square centimeter. Additional $ZnCl_2$ solution was added to the initial electroplating solution at a rate of about 2.2 milliliters per minute for about 20 minutes as the current density was maintained at the previously established levels. The electrodeposition was continued for about another five minutes after the $ZnCl_2$ solution had been added to the initial electroplating solution.

The electric supply was turned off and the electroplating louvered copper mesh was removed from the electroplating bath and leached in an aqueous solution of about 20 percent sodium hydroxide by weight at about 60° C. for about one hour.

At that time, the surface of the electroplated copper mesh was rough and had a dark gray color.

The electroplated copper mesh was then employed as an operating cathode in a membrane cell in the electrolysis of a sodium chloride brine to produce hydrogen, chlorine, and an aqueous solution of sodium hydroxide.

The electrolytic cell employed was a divided flow-through cell. A homogeneous film of cation exchange membrane (about 7 mils thick) previously soaked in an aqueous solution of about 30 percent sodium hydroxide by weight for about 24 hours, and comprised of about a 1150 equivalent weight perfluorosulfonic acid resin which had been chemically modified by ethylene diamine converting the membrane to perfluorosulfonamide to a depth of about 1.2 mils with a fabric backing of polytetrafluoroethylene resin, was positioned vertically in the center of the cell. The membrane formed a catholyte chamber and an anolyte chamber.

The electroplated cathode previously described was positioned in the cathode chamber so that the longer dimension of the previously described apertures was aligned horizontally. The louvers were positioned to direct the hydrogen gas upward and away from the membrane.

An anode comprised of a titanium substrate coated with oxides of ruthenium and titanium was positioned in the anode chamber. Both anode and cathode were positioned parallel to the membrane. Both the anode and the cathode distance to the membrane were set at about 0.3 centimeter.

The catholyte chamber was initially filled with about a 30 percent sodium hydroxide solution for startup purposes. Fresh deionized water was thereafter supplied to the cathode chamber. A saturated solution of sodium chloride brine (about 320 grams sodium chloride per liter) was supplied to the anode chamber.

The anode and cathode were connected to a direct current supply and the electricity was turned on. The hydrogen gas and chlorine gas were collected off the cathode and anode chambers, respectively. An aqueous solution of sodium hydroxide was collected from the cathode chamber.

During electrolysis, the hydrogen overvoltage of the cathode was measured by using a saturated calomel electrode in conjunction with a Luggin capillary positioned about 0.5 centimeter from the electroplated cathode on the side of the electroplated cathode facing the membrane.

At the startup of the cell, the hydrogen overvoltage was measured at about 50 millivolts (mv) or about 335 mv below the hydrogen overvoltage for the unplated nickel of about 385 mv.

Although the sustrate metal used in this example is copper, copper by itself is not a favored cathode for hydrogen evolution in caustic solution because the copper will readily dissolve into the caustic solution and contaminate it when the cell power is turned off. Therefore nickel has been chosen as the standard for comparison in these tests because it has a relatively low hydrogen overvoltage and is stable in caustic solution. Nickel and also steel are commonly used as cathodes in industrial cells of the preceding type.

The cell was operated for about six months at the following conditions:

temperature about 86° C.;

anolyte concentrations about 24 percent sodium chloride by weight;

anolyte pH about 5.2;

catholyte concentration about 37 percent sodium hydroxide by weight;

brine supply rate about 16 milliliters per minute; and deionized water supply rate about 0.2 milliliter per minute.

The hydrogen overvoltage was monitored periodically during the six-month period and remained at about 148 mv or about 237 mv below the unplated nickel hydrogen overvoltage.

EXAMPLE 2

A section of flat nickel mesh was selected as the electrically conductive substrate for electroplating. The section was of similar dimensions as the louvered copper mesh in Example 1, except that the thickness of the flat nickel mesh was about 0.15 centimeter and the length of the mesh apertures was about 0.9 centimeter.

About 955 milliliters of an aqueous electroplating solution was prepared having the following composition:

about 346 g/l $NiSO_4$;

about 47 g/l $NiCl_2$;

about 39 g/l boric acid;

the temperature was about 25° C.; and the pH of the electroplating solution was about 3.3.

In a manner similar to that described in Example 1, the flat nickel metal mesh was inserted in the electroplating solution for about 15 minutes at a current density of about 0.05 ampere per square centimeter.

About 45 milliliters of about a 1 kg/l aqueous solution of $ZnCl_2$ was then added to the above described electroplating solution and the flat nickel mesh was further electroplated for about 15 minutes at a decreased current density of about 0.001 ampere per square centimeter. The current was then increased to a higher current density of about 0.005 ampere per square centimeter for about another 15 minutes. The current was then increased to 0.05 ampere per square centimeter for about another 15 minutes. The current was then finally increased to 0.10 ampere per square centimeter for about 15 minutes. The temperature of the electroplating solution was about 25° C. and the plating solution pH was about 4.6. The electric supply was then turned off and the electroplated flat nickel mesh was removed from the electroplating solution and was leached in an aqueous sodium hydroxide solution as described in Example 1.

The electroplated flat nickel mesh was employed as an operating cathode in a membrane cell used in the electrolysis of sodium chloride brine to produce hydrogen, chlorine, and sodium hydroxide.

The cell employed in Example 2 was similar to the cell employed in Example 1, except that a carboxylic acid substituted polymer of the type described in U.S. Pat. No. 4,065,366, issued Dec. 27, 1977 to Yoshio Oda et al was employed as the membrane.

After startup, the hydrogen overvoltage of the electroplated nickel was measured at about 130 mv or about 255 mv below the hydrogen overvoltage of about 385 mv for unplated nickel cathode.

The cell of Example 2 was operated for about one month at the following condition:

temperature about 90° C.;

anolyte concentration about 24 percent sodium chloride by weight;

catholyte concentration about 32 percent sodium hydroxide by weight;

brine supply rate about 15 milliliters per minute; and water supply rate about 1.1 milliliters per minute.

After about one month the hydrogen overvoltage of the electroplated flat nickel mesh cathode has remained essentially unchanged.

What is claimed is:

1. In a process for preparing an electrode having reduced cathodic hydrogen overvoltage potential in an electrolytic cell, wherein both a low overvoltage metal and a sacrificial metal are electrodeposited onto an electrically conductive substrate by insertion of said electrically conductive substrate into an electroplating solution along with a plating anode, and an electric current is passed from said plating anode to said electrically conductive substrate and the sacrificial metal is removed by leaching with alkali metal hydroxide, the improvement which comprises adding said sacrificial metal to said electroplating solution after electrodeposition is initiated.

2. The process of claim 1, wherein said sacrificial metal is an aqueous solution of zinc chloride.

3. The process of claim 2, wherein the concentration of said zinc chloride is in the range from about 0.1 to about 1,000 grams zinc chloride per liter in said electroplating solution.

4. The process of claim 3, wherein the concentration of said zinc chloride is in the range from about 1 to about 50 grams zinc chloride per liter in said electroplating solution.

5. The process of claim 4, wherein said electroplating solution is an aqueous solution of nickel sulfate, nickel chloride, and boric acid.

6. The process of claim 5, wherein said plating anode is nickel.

7. The process of claim 6, wherein said electrically conductive substrate is comprised of a metal selected from a group consisting of nickel, copper and mixtures thereof.

8. The process of claim 7, wherein said sacrificial metal is added to said electroplating solution in a plurality of additions.

9. The process of claim 8, wherein said sacrificial metal is continuously added to said electroplating solution.

10. An electrode prepared by the process of claim 9.

11. In a method of electrolyzing an aqueous solution of an alkali metal chloride in an electrolytic cell employing an anode and a cathode, the improvement which comprises employing as said cathode, a cathode prepared by the process of claim 1.

12. The process of claim 11, wherein said electrolytic cell is a membrane cell.

13. The process of claim 12, wherein said membrane cell is a filter press cell.

14. The process of claim 13, wherein said filter press cell is a monopolar electrical operation.

* * * * *